US010712062B2

(12) United States Patent
Horiba et al.

(10) Patent No.: US 10,712,062 B2
(45) Date of Patent: Jul. 14, 2020

(54) REFRIGERANT DISTRIBUTOR AND AIR-CONDITIONING APPARATUS USING THE SAME

(71) Applicant: Mitsubishi Electric Corporation, Tokyo (JP)

(72) Inventors: Ryohei Horiba, Tokyo (JP); Tatsunori Sakai, Tokyo (JP); Kumi Aoki, Tokyo (JP); Akihide Terao, Tokyo (JP); Keiichi Tomita, Tokyo (JP); Hirohito Yagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 63 days.

(21) Appl. No.: 15/763,145

(22) PCT Filed: Oct. 26, 2015

(86) PCT No.: PCT/JP2015/080113
§ 371 (c)(1),
(2) Date: Mar. 26, 2018

(87) PCT Pub. No.: WO2017/072833
PCT Pub. Date: May 4, 2017

(65) Prior Publication Data

US 2019/0056158 A1 Feb. 21, 2019

(51) Int. Cl.
*F25B 41/06* (2006.01)
*F25B 13/00* (2006.01)
(Continued)

(52) U.S. Cl.
CPC ..... *F25B 41/06* (2013.01); *F25B 5/02* (2013.01); *F25B 13/00* (2013.01); *F25B 39/02* (2013.01); *F25B 39/028* (2013.01); *F25B 41/00* (2013.01)

(58) Field of Classification Search
CPC ..... F25B 39/02; F25B 39/028; F25B 41/00; F25B 41/06; F25B 5/02; F28D 1/05391; F28F 2220/00; F28F 9/026
See application file for complete search history.

(56) References Cited

U.S. PATENT DOCUMENTS 5,309,728 A * 5/1994 Chae ..... F24F 3/065 62/158
6,606,882 B1 * 8/2003 Gupte ..... F25B 39/028 165/115

(Continued)

FOREIGN PATENT DOCUMENTS

DE 10 2006 055 837 A1 5/2008
JP H06-221720 A 8/1994

(Continued)

OTHER PUBLICATIONS

Extended European Search Report dated May 22, 2019 issued in corresponding EP patent application No. 15907197.6.

(Continued)

*Primary Examiner* — Frantz F Jules
*Assistant Examiner* — Martha Tadesse
(74) *Attorney, Agent, or Firm* — Posz Law Group, PLC

(57) ABSTRACT

A refrigerant distributor includes: a first introduction pipe configured to be open at a first end and closed at a second end and to cause refrigerant to flow from the first end toward the second end; a second introduction pipe configured to be closed in ends on both upstream and downstream sides and to cause the refrigerant to flow in a direction opposite to a refrigerant flow direction in the first introduction pipe; a plurality of branch pipes connected in series along a refrigerant flow direction on the second introduction pipe; and an adjusting pipe configured to connect the first introduction pipe and the second introduction pipe.

7 Claims, 10 Drawing Sheets

(51) Int. Cl.

| | |
|---|---|
| ***F25B 39/02*** | (2006.01) |
| ***F25B 41/00*** | (2006.01) |
| ***F25B 5/02*** | (2006.01) |

(56) References Cited

U.S. PATENT DOCUMENTS

| | | | | |
|---|---|---|---|---|
| 6,688,137 | B1 * | 2/2004 | Gupte | F25B 39/022<br>62/515 |
| 7,044,200 | B2 * | 5/2006 | Gupte | F25B 39/02<br>165/103 |
| 2005/0262872 | A1 * | 12/2005 | Sacks | F25B 39/02<br>62/500 |
| 2007/0000276 | A1 * | 1/2007 | Tso | F25B 13/00<br>62/324.1 |
| 2008/0110604 | A1 * | 5/2008 | Janssen | F25B 39/028<br>165/151 |
| 2010/0293980 | A1 * | 11/2010 | Shimaoka | F25B 39/028<br>62/259.1 |
| 2010/0314090 | A1 * | 12/2010 | Moriya | F25B 39/028<br>165/174 |
| 2013/0327503 | A1 * | 12/2013 | Koch | F25B 39/00<br>165/104.21 |
| 2014/0123696 | A1 * | 5/2014 | Kim | F25B 13/00<br>62/498 |
| 2017/0299284 | A1 * | 10/2017 | Jindou | F25B 13/00 |

FOREIGN PATENT DOCUMENTS

| | | | | | |
|---|---|---|---|---|---|
| JP | 08247581 | A | * | 9/1996 | F16L 41/02 |
| JP | 2007-139231 | A | | 6/2007 | |
| JP | 2007139231 | A | * | 6/2007 | |
| JP | 2008-122070 | A | | 5/2008 | |
| JP | 2008286488 | A | * | 11/2008 | |
| JP | 2011085324 | A | * | 4/2011 | |
| JP | 2012063137 | A | * | 3/2012 | |
| JP | 2012-172862 | A | | 9/2012 | |

OTHER PUBLICATIONS

International Search Report of the International Searching Authority dated Dec. 28, 2015 for the corresponding International application No. PCT/JP2015/080113 (and English translation).

* cited by examiner

REFRIGERANT DISTRIBUTOR AND AIR-CONDITIONING APPARATUS USING THE SAME

CROSS REFERENCE TO RELATED APPLICATION

This application is a U.S. national stage application of International Application No. PCT/JP2015/080113, filed on Oct. 26, 2015, the contents of which are incorporated herein by reference.

TECHNICAL FIELD

The present invention relates to a refrigerant distributor configured to distribute refrigerant among plural indoor units as well as relates to an air-conditioning apparatus using the refrigerant distributor.

BACKGROUND

In general, an air-conditioning apparatus uses a refrigeration cycle formed by a compressor, a condenser, an expansion valve, and an evaporator connected in series via refrigerant pipes. In the refrigeration cycle, low-pressure gas refrigerant sucked into the compressor is compressed to predetermined high pressure, then led to the condenser, and turned into high-pressure liquid refrigerant by exchanging heat with air. The high-pressure liquid refrigerant is led to the expansion valve to be expanded therein, then sent to the evaporator as low-pressure, two-phase gas-liquid refrigerant, turned into low-pressure gas by exchanging heat with air, and sucked into the compressor and compressed again, thus circulating in the above-mentioned refrigeration cycle.

In some of such air-conditioning apparatuses, for example, a single outdoor unit is connected with two or more indoor units. In this case, it is necessary to distribute refrigerant equally to all the indoor units. In particular, during cooling operation of the air-conditioning apparatus, because the refrigerant introduced into an indoor unit equipped with an evaporator is in a two-phase gas-liquid state or in a liquid-phase state, it is important in maintaining performance of a heat exchanger to distribute liquid-phase refrigerant and gas-phase refrigerant equally to all the indoor units.

Thus, a refrigerant distributor is proposed in which notches are provided in end faces of plural branch pipes inserted into an introduction pipe through which refrigerant flows and the notches receive the flowing refrigerant, thereby allowing the refrigerant to be distributed equally to all the branch pipes (see, for example, Patent Literature 1).

On the other hand, a refrigerant distributor is proposed in which one end of an adjusting pipe is connected to a connecting member between a refrigerant pipe and a diversion pipe while an other end of the adjusting pipe is closed, which allows refrigerant to be stirred at the closed other end of the adjusting pipe, thereby equalizing the refrigerant flowing through the diversion pipe (see, for example, Patent Literature 2).

PATENT LITERATURE

Patent Literature 1: Japanese Unexamined Patent Application Publication No. 2007-139231

Patent Literature 2: Japanese Unexamined Patent Application Publication No. 6-221720

In the refrigerant distributor described in Patent Literature 1, amounts of distribution of refrigerant vary, for example, with the insertion length and angle of the branch pipes inserted into the introduction pipe, posing a problem in that manufacturing management of the refrigerant distributor is difficult, which makes quality variations liable to occur in manufacturing processes. Also, for example, if part of the introduction pipe is given a U-shape, centrifugal force acts on liquid-phase refrigerant in a U-shaped bend, shifting the liquid-phase refrigerant to a side different from a side on which the branch pipes are placed. Consequently, the liquid refrigerant cannot be received uniformly by the branch pipes, posing a problem in that the refrigerant cannot be distributed equally to the plural branch pipes.

In the refrigerant distributor described in Patent Literature 2, the refrigerant is stirred in the adjusting pipe, and the diversion pipe through which the refrigerant subsequently flows branches off in an up/down direction. Consequently, due to density of the refrigerant, the gas-phase refrigerant tends to flow upward and the liquid-phase refrigerant tends to flow downward, posing a problem in that it is difficult to distribute the refrigerant equally. Also, since the amounts of distribution vary with the inclination of the adjusting pipe, there is a problem in that manufacturing management of the refrigerant distributor is difficult, which makes quality variations liable to occur in manufacturing processes.

SUMMARY

The present invention has been made in view of the above problems and has an object to provide a refrigerant distributor capable of distributing refrigerant equally among plural indoor units as well as providing an air-conditioning apparatus that uses the refrigerant distributor.

A refrigerant distributor according to an embodiment of the present invention comprises: a first introduction pipe configured to be open at a first end and closed at a second end and to cause refrigerant to flow from the first end toward the second end; a second introduction pipe configured to be closed in ends on both upstream and downstream sides and to cause the refrigerant to flow in a direction opposite to a refrigerant flow direction in the first introduction pipe; a plurality of branch pipes connected to the second introduction pipe along the direction of the refrigerant through the second introduction pipe; and an adjusting pipe configured to connect the first introduction pipe and the second introduction pipe, the adjusting pipe connecting a part of the first introduction pipe, the part being on a side of the second end, connecting a side of the second end of the first introduction pipe to between an end of the second introduction pipe on the upstream side and a branch pipe of the branch pipes, the branch pipe being connected to a most upstream side of the second introduction pipe among the branch pipes.

According to the embodiment of the present invention, the refrigerant distributor includes the adjusting pipe, which is configured to connect a part of the first introduction pipe that is on a side of the second end to between an end of the second introduction pipe on the upstream side and a most upstream side of the second introduction pipe. This makes it possible to cancel out centrifugal force generated when refrigerant flows from the first introduction pipe to the second introduction pipe as well as to stir the refrigerant, and thereby provide a refrigerant distributor capable of distributing refrigerant equally among plural indoor units as well as to provide an air-conditioning apparatus that uses the refrigerant distributor.

DETAILED DESCRIPTION

Figure 1:
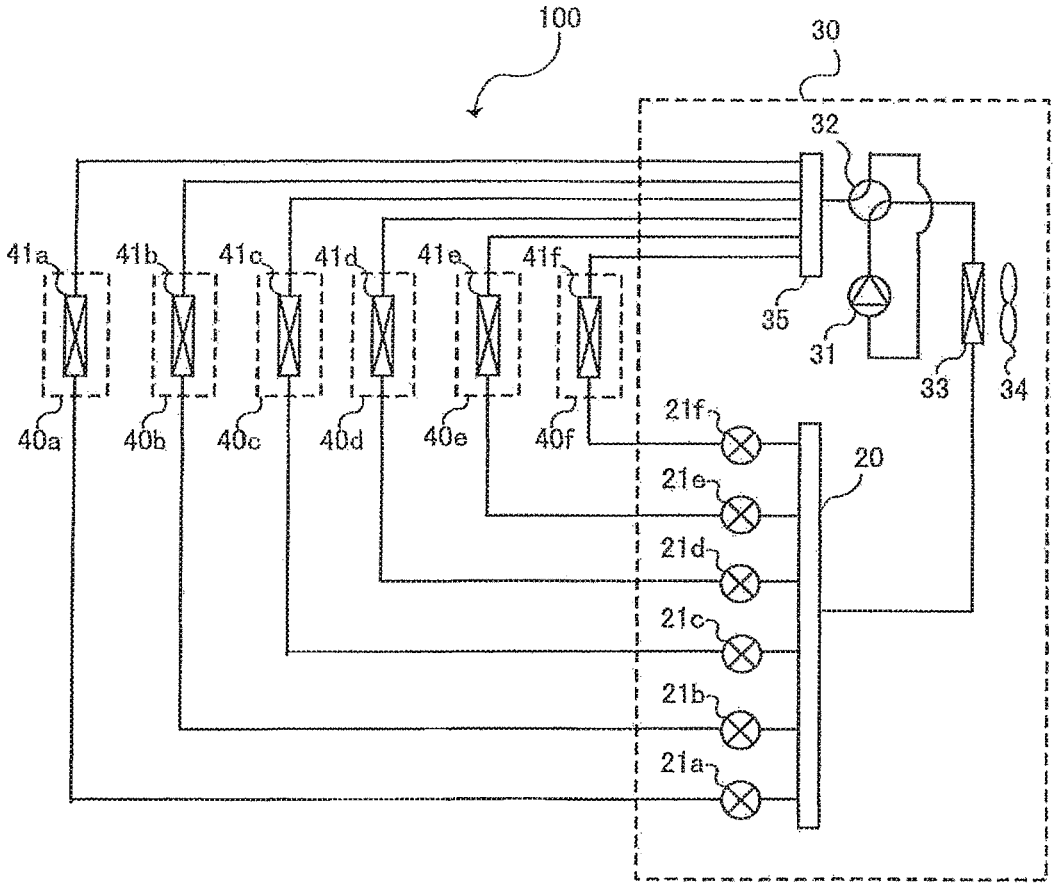
FIG. 1 is a circuit diagram of an air-conditioning apparatus equipped with a refrigerant distributor according to Embodiment 1 of the present invention.

Embodiments of an outdoor unit of an air-conditioning apparatus according to the present invention will be described below with reference to the accompanying drawings. Note that the embodiments shown in the drawings are examples and are not intended to limit the present invention. Also, in the drawings, components denoted by the same reference numerals are identical or equivalent components. This applies throughout the entire specification. Furthermore, in the following drawings, components may not be shown in their true size relations.

Embodiment 1

[Configuration of Air-Conditioning Apparatus]

FIG. 1 is a circuit diagram of an air-conditioning apparatus equipped with a refrigerant distributor according to Embodiment 1 of the present invention. As shown in FIG. 1, the air-conditioning apparatus 100 includes one outdoor unit 30 and six indoor units: an indoor unit 40*a*, indoor unit 40*b*, indoor unit 40*c*, indoor unit 40*d*, indoor unit 40*e*, and indoor unit 40*f*. The outdoor unit 30 is provided with a compressor 31, a four-way valve 32, an outdoor heat exchanger 33, a refrigerant distributor 20, an outdoor expansion valve 21*a*, an outdoor expansion valve 21*b*, an outdoor expansion valve 21*c*, an outdoor expansion valve 21*d*, an outdoor expansion valve 21*e*, an outdoor expansion valve 21*f*, and a gas branching header 35, which are connected in series via refrigerant pipes. Also, an outdoor fan 34 is placed in a neighborhood of the outdoor heat exchanger 33. When the air-conditioning apparatus 100 is a cooling-only model, the four-way valve 32 does not need to be provided. Note that the outdoor heat exchanger 33 corresponds to a "condenser" according to the present invention.

Note that the indoor units 40*a* to 40*f* will be referred to as the indoor unit(s) 40 when there is no need to specifically distinguish among the indoor units 40*a* to 40*f*. Also, the outdoor expansion valves 21*a* to 21*f* will be referred to as the outdoor expansion valve(s) 21 when there is no need to specifically distinguish among the outdoor expansion valves 21*a* to 21*f*.

The indoor units 40*a* to 40*f* are connected to the outdoor unit 30 in parallel by branching from the refrigerant distributor 20 via refrigerant pipes. The indoor units 40*a* to 40*f* are connected to the gas branching header 35 via refrigerant pipes. Indoor heat exchangers 41*a* to 41*f* are provided in the indoor units 40*a* to 40*f*, respectively. Note that the indoor heat exchangers 41*a* to 41*f* will be referred to as the indoor heat exchanger(s) 41 when there is no need to specifically distinguish among the indoor heat exchangers 41*a* to 41*f*. Note that the indoor heat exchanger 41 corresponds to an "evaporator" according to the present invention.

Note that although an example in which six each of the indoor units 40, indoor heat exchangers 41, and outdoor expansion valves 21 are provided has been shown in Embodiment 1, the present invention is not limited to this, and it is enough that two or more of each of the indoor units 40, indoor heat exchangers 41, and outdoor expansion valves 21 are provided. This also applies to Embodiments 2 and 3 described later.

[Operation of Air-Conditioning Apparatus]

Next, flow of refrigerant during cooling operation will be described. High-pressure gas refrigerant compressed by the compressor 31 flows into the outdoor heat exchanger 33 through the four-way valve 32. The high-pressure gas refrigerant flowing into the outdoor heat exchanger 33 is cooled by exchanging heat with outdoor air by means of the outdoor fan 34 and condensed into high-pressure liquid refrigerant. The high-pressure liquid refrigerant flowing out of the outdoor heat exchanger 33 is decompressed by the outdoor expansion valves 21 to become low-pressure refrigerant in a two-phase gas-liquid state. The two-phase gas-liquid refrigerant is distributed to the individual indoor units 40 by the refrigerant distributor 20 and flows into the individual indoor heat exchangers 41. The two-phase gas-liquid refrigerant flowing into the indoor units 40 evaporates by exchanging heat with indoor air to become low-pressure gas refrigerant. The low-pressure gas refrigerant is collected in the gas branching header 35, is sent to the compressor through the four-way valve 32, and circulates through a refrigerant circuit again. Note that the gas branching header 35 may be a conventional one and does not need to have special technical features.

[Conventional Refrigerant Distributor]

Before describing the refrigerant distributor according to Embodiment 1, a conventional refrigerant distributor will be described first.

Figure 2:
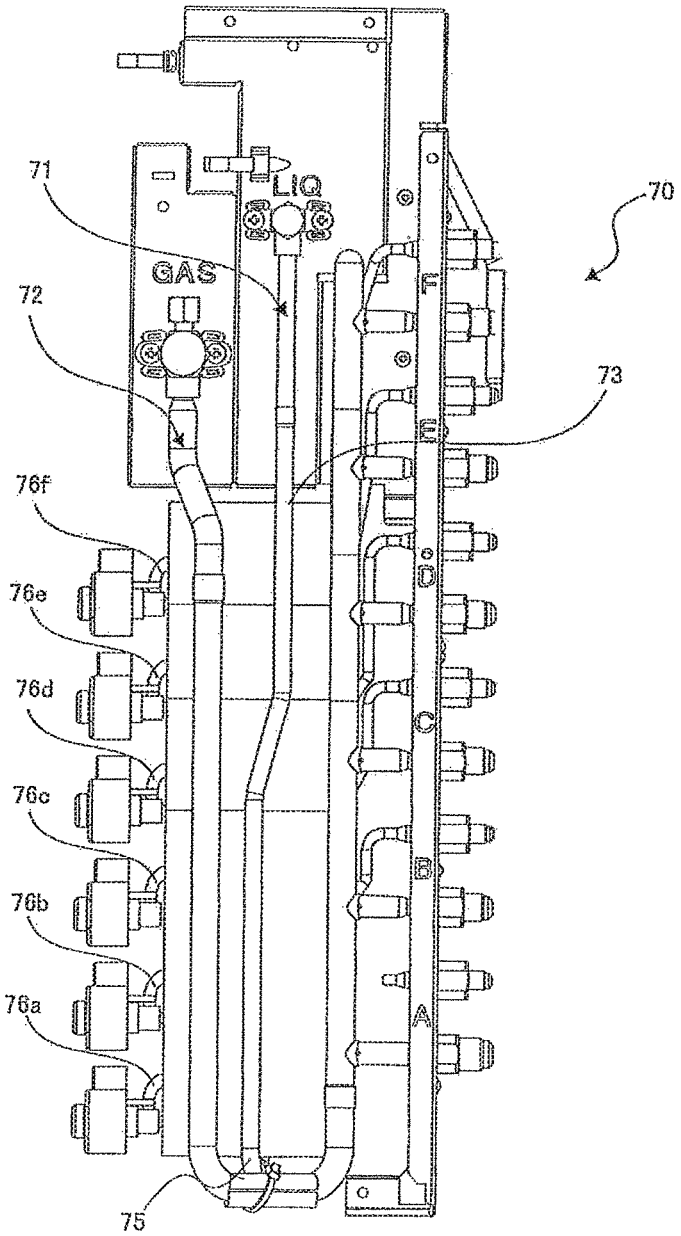
FIG. 2 is a schematic front view of a conventional refrigerant branching unit.
Figure 3:
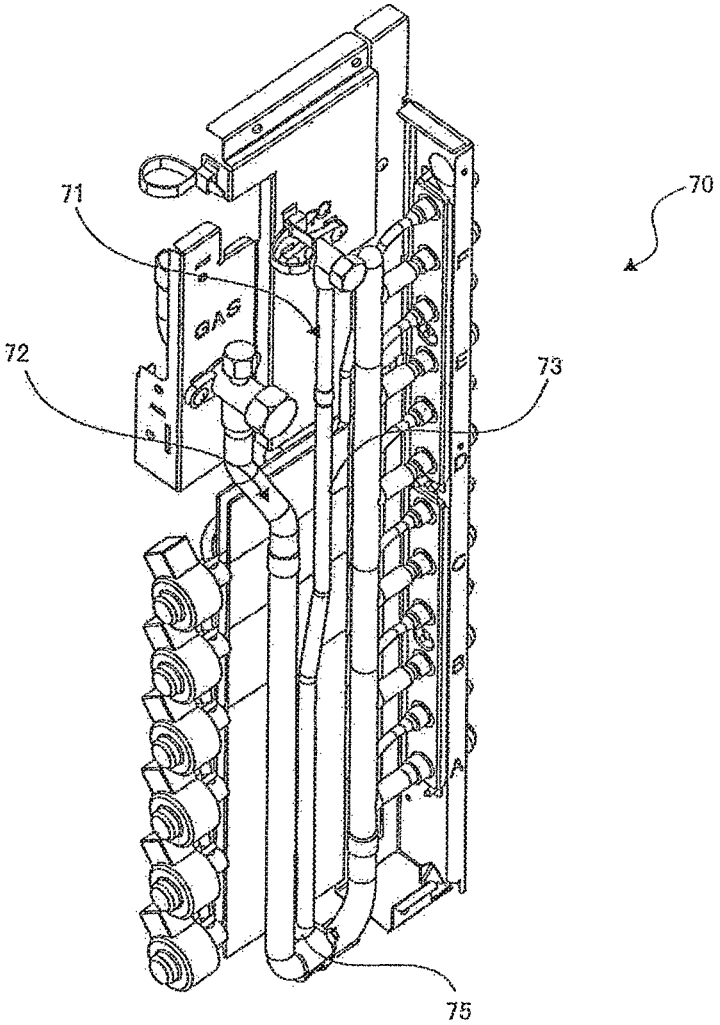
FIG. 3 is a schematic perspective view of the conventional refrigerant branching unit.
Figure 4:
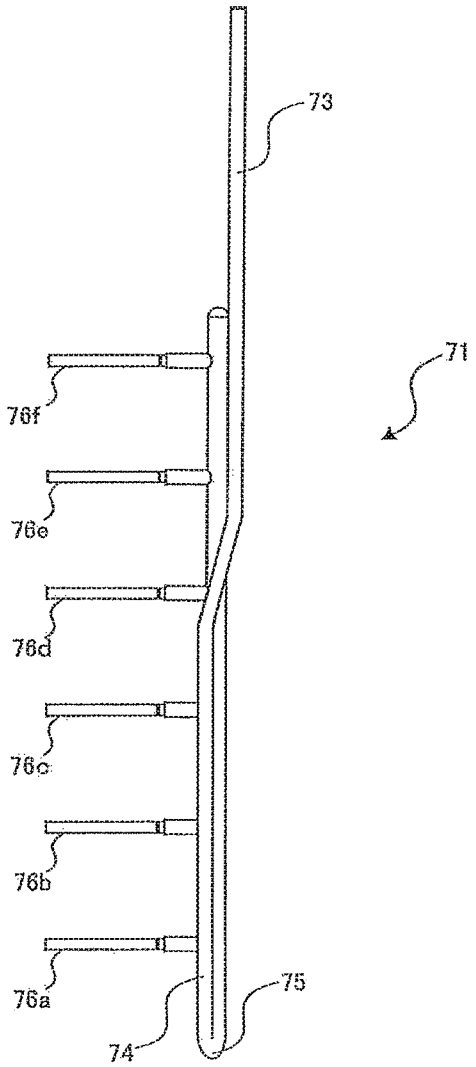
FIG. 4 is a schematic side view of a refrigerant distributor provided on the conventional refrigerant branching unit.
Figure 5:
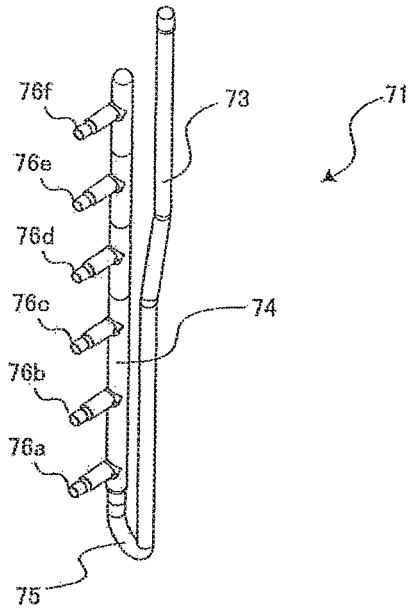
FIG. 5 is a schematic perspective view of the refrigerant distributor provided on the conventional refrigerant branching unit.
Figure 6:
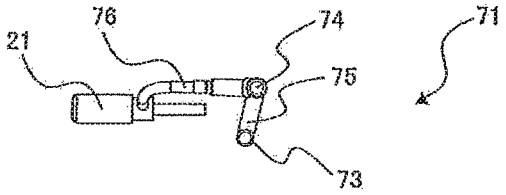
FIG. 6 is a schematic top view of the conventional refrigerant distributor.

FIG. 2 is a schematic front view of a conventional refrigerant branching unit. FIG. 3 is a schematic perspective view of the conventional refrigerant branching unit. FIG. 4 is a schematic side view of a refrigerant distributor provided on the conventional refrigerant branching unit. FIG. 5 is a schematic perspective view of the refrigerant distributor provided on the conventional refrigerant branching unit. FIG. 6 is a schematic top view of the conventional refrigerant distributor.

As shown in FIGS. 2 to 6, the conventional refrigerant branching unit 70 includes a refrigerant distributor 71 configured to distribute liquid refrigerant and a gas branching header 72 configured to branch gas refrigerant. As shown in FIGS. 4 and 5, the refrigerant distributor 71 connects an introduction pipe 73 configured to cause refrigerant to flow from top to bottom and an introduction pipe 74 configured to cause the refrigerant to flow from bottom to top, via a U-shaped introduction pipe 75. The introduction pipe 74 is connected with a branch pipe 76*a*, branch pipe 76*b*, branch pipe 76*c*, branch pipe 76*d*, branch pipe 76*e*, and branch pipe 76*f* at predetermined intervals along a refrigerant flow direction, where the branch pipes 76*a* to 76*f* are used to distribute the refrigerant to the individual indoor units. Note that the branch pipes are connected to the introduction pipe 74 in such a way that the branch pipe 76*a*, branch pipe 76*b*, branch pipe 76*c*, branch pipe 76*d*, branch pipe 76*e*, and branch pipe 76*f* will increase in height in series, with the branch pipe 76*a* installed at the lowest position.

In this way, the conventional refrigerant distributor 71 causes the refrigerant to flow from top to bottom of the introduction pipe 73, pass through the U-shaped introduction pipe 75, and flow from bottom to top into the introduction pipe 74. The refrigerant flowing into the introduction pipe 74 is branched and distributed to the branch pipe 76*a*, branch pipe 76*b*, branch pipe 76*c*, branch pipe 76*d*, branch pipe 76*e*, and branch pipe 76*f*.

Figure 7:
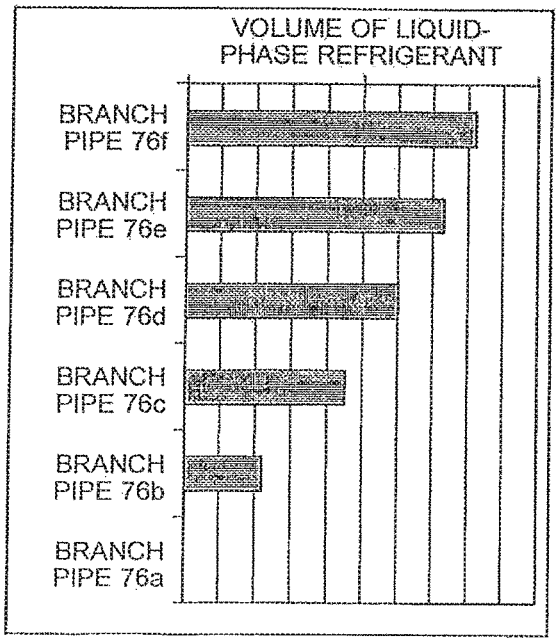
FIG. 7 is a diagram showing amounts of liquid refrigerant distributed to respective branch pipes in the conventional refrigerant distributor.

FIG. 7 is a diagram showing amounts of liquid refrigerant distributed to respective branch pipes in the conventional refrigerant distributor. Now, analysis was conducted to see how equally refrigerant was distributed to branch pipes, i.e., the branch pipe 76*a*, branch pipe 76*b*, branch pipe 76*c*, branch pipe 76*d*, branch pipe 76*e*, and branch pipe 76*f*, and analysis results shown in FIG. 7 were obtained. As shown in FIG. 7, liquid-phase refrigerant is distributed to the branch pipe 76*f*, branch pipe 76*e*, branch pipe 76*d*, branch pipe 76*c*, branch pipe 76*b*, and branch pipe 76*a* in decreasing order of amount. That is, the higher the location of the branch pipe on the introduction pipe 74, the larger the distributed amount of liquid-phase refrigerant, and little liquid-phase refrigerant is distributed to the branch pipe provided at the lowest location.

A reason why the mounts of refrigerant distributed to the upper branch pipes is smaller than the amounts of the refrigerant distributed to the lower branch pipes is that the liquid-phase refrigerant deflected under the influence of centrifugal force generated in the U-shaped introduction pipe 75 and exerted on the liquid-phase refrigerant flowing off an inlet to the branch pipes.

Next, by installing the branch pipes in a centrifugal direction, i.e., in the direction in which the liquid-phase refrigerant is deflected, the amount of liquid-phase refrigerant flowing into each branch pipe was analyzed. Again, the result was that the higher the location of the branch pipe on the introduction pipe 74, the larger the distributed amount of liquid-phase refrigerant, with little liquid-phase refrigerant being distributed to the branch pipe provided at the lowest location. A reason is that flow velocity of the liquid-phase refrigerant was increased by the centrifugal force, making it difficult for the refrigerant to flow into the lowest branch pipe through which the liquid-phase refrigerant passed at a high flow velocity.

[Configuration of Refrigerant Distributor]

Figure 8:
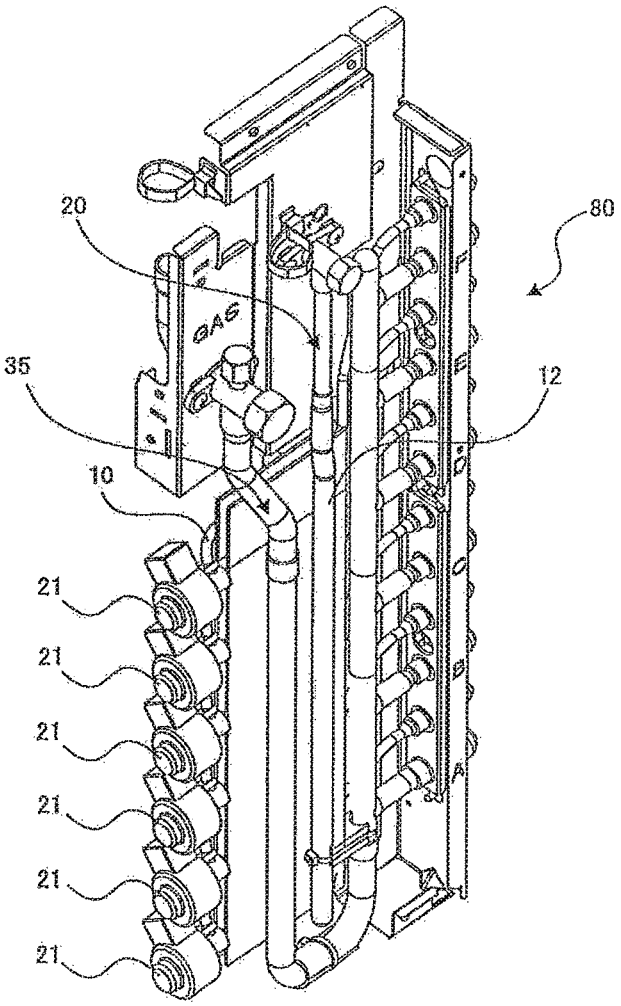
FIG. 8 is a schematic perspective view of a refrigerant branching unit equipped with the refrigerant distributor according to Embodiment 1 of the present invention.
Figure 9:
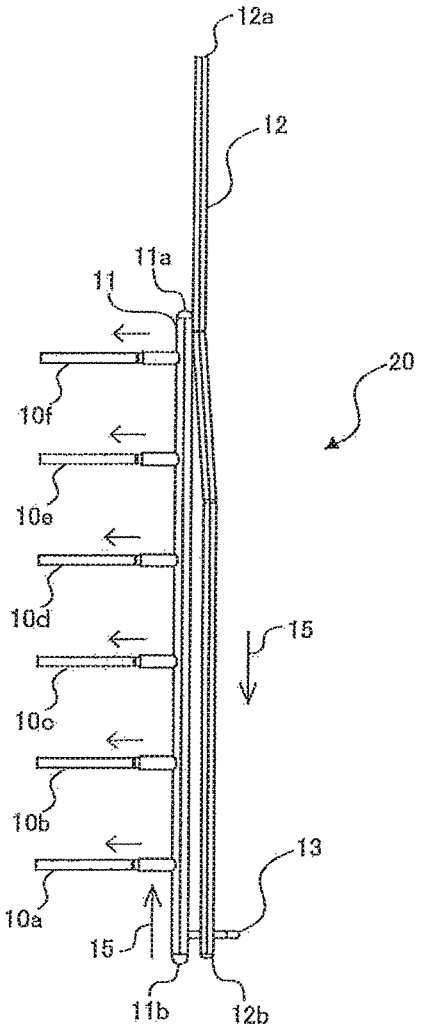
FIG. 9 is a schematic side view of the refrigerant distributor according to Embodiment 1 of the present invention.
Figure 10:
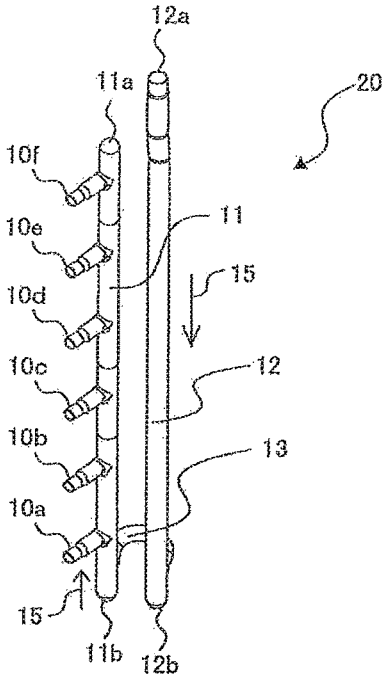
FIG. 10 is a schematic perspective view of the refrigerant distributor according to Embodiment 1 of the present invention.
Figure 11:
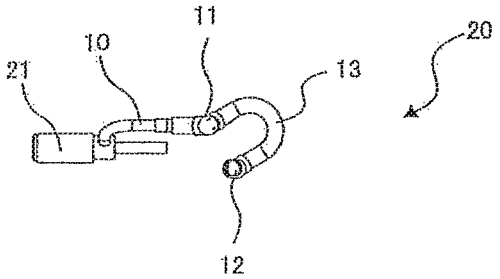
FIG. 11 is a schematic top view of the refrigerant distributor according to Embodiment 1 of the present invention.

Next, the refrigerant distributor according to Embodiment 1 will be described. FIG. 8 is a schematic perspective view of a refrigerant branching unit equipped with the refrigerant distributor according to Embodiment 1 of the present invention. FIG. 9 is a schematic side view of the refrigerant distributor according to Embodiment 1 of the present invention. FIG. 10 is a schematic perspective view of the refrigerant distributor according to Embodiment 1 of the present invention. FIG. 11 is a schematic top view of the refrigerant distributor according to Embodiment 1 of the present invention.

As shown in FIGS. 8 to 11, the refrigerant branching unit 80 includes a refrigerant distributor 20 configured to distribute liquid refrigerant and a gas branching header 35 configured to branch gas refrigerant. As shown in FIGS. 9 and 10, the refrigerant distributor 20 connects a first introduction pipe 12 configured to cause refrigerant to flow from top to bottom and a second introduction pipe 11 configured to cause the refrigerant to flow from bottom to top, via an adjusting pipe 13 U-shaped in top view. When placed vertically in a level flat site, the first introduction pipe 12 is open in an upper end 12*a* and closed in a lower end 12*b*, and causes refrigerant to flow from top to bottom. On the other hand, when placed vertically in a level flat site, the second introduction pipe 11 is open both in a lower end 11*b* located on an upstream side and in an upper end 11*a* located on a downstream side, and causes the refrigerant to flow from bottom to top. Note that arrows in Figs. indicate flow 15 of refrigerant. Note that the upper end 12*a* corresponds to a "first end" according to the present invention. Also, the lower end 12*b* corresponds to a "second end" according to the present invention.

The second introduction pipe 11 and first introduction pipe 12 are, for example, 12.0 (mm) in outside diameter and 0.7 (mm) in wall thickness. Also, the adjusting pipe 13 is, for example, 9.52 (mm) in outside diameter and 0.7 (mm) in wall thickness, and U-shaped in top view. In this way, when the adjusting pipe 13 is designed to be smaller in inside diameter than the second introduction pipe 11 and first introduction pipe 12, even when amount of circulating refrigerant is small, sufficient flow velocity of refrigerant is secured by the adjusting pipe 13, allowing two-phase gas-liquid refrigerant flowing into the second introduction pipe 11 to be stirred sufficiently. Note that although in Embodiment 1, concrete size values of the second introduction pipe 11, first introduction pipe 12, and adjusting pipe 13 have been shown by example, the present invention is not limited to this, and the sizes may be changed as appropriate according to the scale of the air-conditioning apparatus 100, type of refrigerant, or the like.

The second introduction pipe 11 is connected with a branch pipe 10*a*, branch pipe 10*b*, branch pipe 10*c*, branch pipe 10*d*, branch pipe 10*e*, and branch pipe 10*f* at predetermined intervals along the refrigerant flow direction, where the branch pipes 10*a* to 10*f* are used to distribute the refrigerant to the individual indoor units. Note that the branch pipes are installed in the second introduction pipe 11 in such a way that the branch pipe 10*a*, branch pipe 10*b*, branch pipe 10*c*, branch pipe 10*d*, branch pipe 10*e*, and branch pipe 10*f* will increase in height in series, with the branch pipe 10*a* installed at the lowest position. Note that although in the example shown in Embodiment 1, six branch pipes 10*a* to 10*f* are connected to the second introduction pipe 11, the present invention is not limited to this, and it is enough that two or more branch pipes are connected to the second introduction pipe 11. This also applies to Embodiments 2 and 3 described later. Also, the branch pipes 10*a* to 10*f* will be referred to as the branch pipe(s) 10 when there is no need to specifically distinguish among the branch pipes 10*a* to 10*f*. Also, as shown in FIGS. 8 and 11, the outdoor expansion valves 21 are provided on a downstream side of the branch pipes 10.

[Description of Adjusting Pipe]

Figure 12:
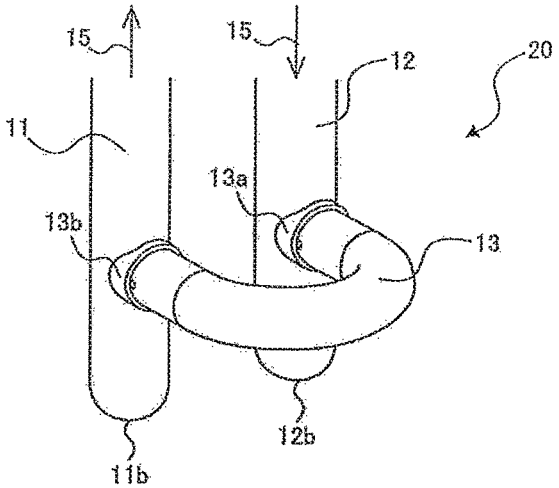
FIG. 12 is an enlarged schematic perspective view of a lower end of the refrigerant distributor according to Embodiment 1 of the present invention.

FIG. 12 is an enlarged schematic perspective view of a lower end of the refrigerant distributor according to Embodiment 1 of the present invention. As shown in FIG. 12, the adjusting pipe 13 is connected to the first introduction pipe 12 via a connecting member 13*a*. Also, the adjusting pipe 13 is connected to the second introduction pipe 11 via a connecting member 13*b*. That is, the adjusting pipe 13 connects a part of the first introduction pipe 12 that is on the side of the lower end 12*b* to between the lower end 11*b* of the second introduction pipe 11 on the upstream side and the branch pipe 10*a* connected to the most upstream side of the second introduction pipe 11. The adjusting pipe 13 is installed at an angle of 90 degrees to the second introduction pipe 11 and first introduction pipe 12.

Also, the adjusting pipe 13 is hermetically inserted to the second introduction pipe 11 via the connecting member 13*b* opened and hermetically inserted to the first introduction pipe 12 via the opened connecting member 13*a*. Therefore, it is necessary to design the adjusting pipe 13 to be smaller in outside diameter than the second introduction pipe 11 and first introduction pipe 12. Also, the adjusting pipe 13 is installed in positions at a height of 25 (mm) from the lower end 11*b* and lower end 12*b*. Note that although in the example shown in Embodiment 1, the adjusting pipe 13 is installed in positions at a height of 25 (mm) from the lower end 11*b* and lower end 12*b*, the present invention is not limited to this, and the height may be changed as appropriate according to the scale of the air-conditioning apparatus 100, type of refrigerant, or the like. Also, although in the example shown in FIG. 12, the lower end 11*b* and lower end 12*b* have a same height, the lower end 11*b* and lower end 12*b* may differ from each other in height. These matters also apply to Embodiments 2 and 3 described later.

[Behavior of Refrigerant in Refrigerant Distributor]

Next, behavior of refrigerant in the refrigerant distributor 20 will be described.

As shown in FIG. 12, the two-phase gas-liquid refrigerant flowing into the first introduction pipe 12 from top to bottom hits an inner wall surface of the lower end 12*b* of the first introduction pipe 12, cancelling out downward momentum and stirring gas-phase refrigerant and liquid-phase refrigerant. Then, the two-phase gas-liquid refrigerant flows into the adjusting pipe 13 through the connecting member 13*a*. Since the adjusting pipe 13 has a U-shape, centrifugal force acts on the two-phase gas-liquid refrigerant. The two-phase gas-liquid refrigerant flowing out of the adjusting pipe 13 through the connecting member 13*b* flows into the second introduction pipe 11. In so doing, the two-phase gas-liquid refrigerant hits an inner wall surface of the second introduction pipe 11 and an inner wall surface of the lower end 11*b*, thereby cancelling out the centrifugal force, reducing the flow velocity, and further facilitating stirring of the two-phase gas-liquid refrigerant by impact of the hit. With the centrifugal force cancelled out, the two-phase gas-liquid refrigerant stirred sufficiently flows upward in the second introduction pipe 11, and is distributed to the individual branch pipes 10. In this way, by cancelling out the centrifugal force acting on the two-phase gas-liquid refrigerant, reducing the flow velocity of the refrigerant, stirring the refrigerant sufficiently, and then distributing the two-phase gas-liquid refrigerant to the individual branch pipes 10, it becomes possible to distribute homogeneous refrigerant to each indoor unit.

Figure 13:
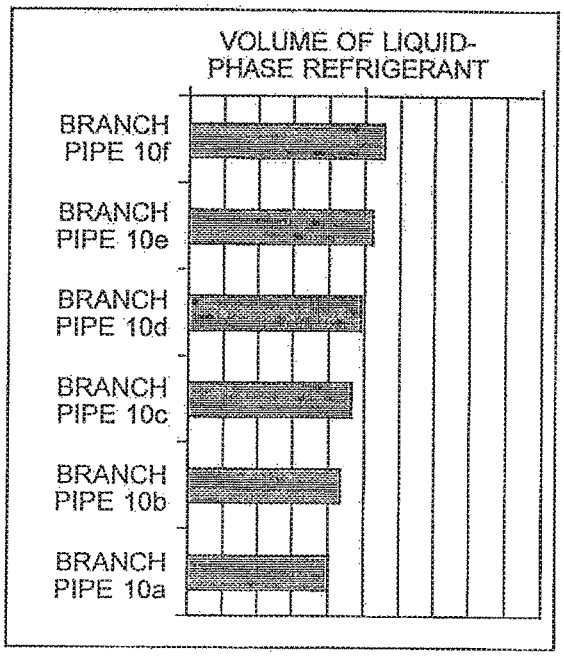
FIG. 13 is a diagram showing amounts of liquid refrigerant distributed to respective branch pipes in the refrigerant distributor according to Embodiment 1 of the present invention.

FIG. 13 is a diagram showing amounts of liquid refrigerant distributed to respective branch pipes in the refrigerant distributor according to Embodiment 1 of the present invention. As shown in FIG. 13, the amounts of liquid-phase refrigerant distributed to the respective branch pipes 10*a* to 10*f* are improved compared to distribution characteristics shown in FIG. 7, and the liquid-phase refrigerant is distributed equally among the branch pipes 10*a* to 10*f*. In this way, since the second introduction pipe 11 equipped with the branch pipes 10*a* to 10*f* is connected with the first introduction pipe 12 via the adjusting pipe 13, the deflection of refrigerant caused by the centrifugal force generated due to shape of the conventional refrigerant distributor 71 and resulting increases in the flow velocity of the refrigerant can be cancelled out by the first introduction pipe 12, second introduction pipe 11, and adjusting pipe 13.

Advantageous Effects of Embodiment 1

Thus, according to Embodiment 1, a refrigerant distributor 20 includes: a first introduction pipe 12 configured to be open at a first end and closed at a second end and to cause refrigerant to flow from the first end toward the second end; a second introduction pipe 11 configured to be closed in ends on both upstream and downstream sides and to cause the refrigerant to flow in a direction opposite to a refrigerant flow direction in the first introduction pipe; a plurality of branch pipes 10 connected along a refrigerant flow direction on the second introduction pipe 11; and an adjusting pipe 13 configured to connect the first introduction pipe 12 and the second introduction pipe 11, wherein the adjusting pipe 13 connects a part of the first introduction pipe 12 that is on a side of the second end to between an end of the second introduction pipe 11 on the upstream side and the branch pipe 10 connected to the most upstream side of the second introduction pipe 11. This provides the refrigerant distributor 20 capable of distributing two-phase gas-liquid refrigerant equally among plural indoor units 40.

Also, when placed vertically, the first introduction pipe 12 causes the refrigerant to flow from top to bottom while the second introduction pipe 11 causes the refrigerant to flow from bottom to top. This provides the refrigerant distributor 20 capable of stirring two-phase gas-liquid refrigerant sufficiently.

Also, the adjusting pipe 13 has a diameter smaller than the inside diameter of the first introduction pipe 12 and the second introduction pipe 11. Consequently, even when the amount of circulating refrigerant is small, sufficient flow velocity of refrigerant is secured by the adjusting pipe 13, allowing the two-phase gas-liquid refrigerant flowing into the second introduction pipe 11 to be stirred sufficiently.

Also, the adjusting pipe 13 has a U-shape in top view. This allows the refrigerant flowing out of the first introduction pipe 12 to hit the inner wall surface of the second introduction pipe 11 and provides the refrigerant distributor 20 capable of cancelling out the centrifugal force acting on the refrigerant and increases in the flow velocity.

Also, the adjusting pipe 13 is installed perpendicularly to the first introduction pipe 12 and second introduction pipe 11. This allows the refrigerant flowing out of the first introduction pipe 12 to hit the inner wall surface of the second introduction pipe 11 perpendicularly and provides the refrigerant distributor 20 capable of efficiently cancelling out the centrifugal force acting on the refrigerant and increases in the flow velocity.

Also, the air-conditioning apparatus 100 is provided with a refrigeration cycle formed by the compressor 31, outdoor heat exchanger 33, plural outdoor expansion valves 21, and plural indoor heat exchangers 41 connected in series via refrigerant pipes, in which the refrigerant distributor 20 is provided between the outdoor heat exchanger 33 and the plural outdoor expansion valves 21. This provides the air-conditioning apparatus 100 equipped with the refrigerant distributor 20 capable of distributing two-phase gas-liquid refrigerant equally among plural indoor units 40.

Embodiment 2

A basic configuration of a refrigerant distributor according to Embodiment 2 is similar to that of the refrigerant distributor according to Embodiment 1, and thus Embodiment 2 will be described below by focusing on differences from Embodiment 1. A difference of Embodiment 2 from Embodiment 1 lies in that an adjusting pipe is inclined with respect to a first introduction pipe and second introduction pipe.

Figure 14:
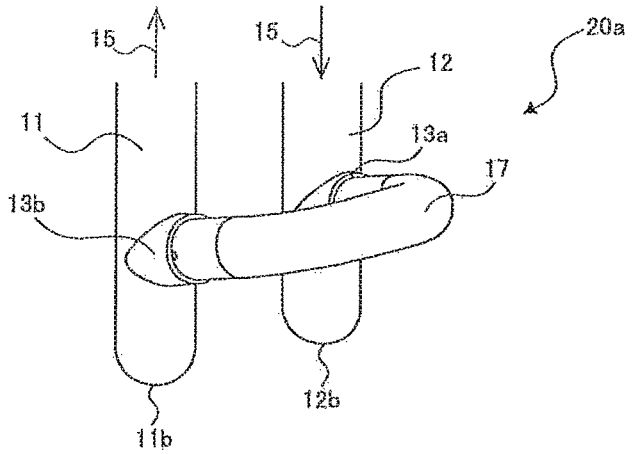
FIG. 14 is an enlarged schematic perspective view of a lower end of a refrigerant distributor according to Embodiment 2 of the present invention.

FIG. 14 is an enlarged schematic perspective view of a lower end of the refrigerant distributor according to Embodiment 2 of the present invention. As shown in FIG. 14, a refrigerant distributor 20*a* includes an adjusting pipe 17, a first introduction pipe 12, and a second introduction pipe 11. The adjusting pipe 17 has a U-shape in top view. The adjusting pipe 17 is connected to the first introduction pipe 12 via a connecting member 13*a*, and to the second introduction pipe 11 via a connecting member 13*b*. When the first introduction pipe 12 and second introduction pipe 11 are placed vertically in a level flat site, the adjusting pipe 17 is connected to the first introduction pipe 12 and second introduction pipe 11 by being inclined toward the branch pipes 10. That is, the adjusting pipe 17 is connected to the first introduction pipe 12 and second introduction pipe 11 by being inclined upward.

[Behavior of Refrigerant in Refrigerant Distributor]

Next, behavior of refrigerant in the refrigerant distributor 20*a* will be described.

As shown in FIG. 14, two-phase gas-liquid refrigerant flowing into the first introduction pipe 12 from top to bottom hits an inner wall surface of the lower end 12*b* of the first introduction pipe 12, cancelling out downward momentum and stirring gas-phase refrigerant and liquid-phase refrigerant. Then, the two-phase gas-liquid refrigerant flows into the adjusting pipe 17 through the connecting member 13*a*. Since the adjusting pipe 17 has a U-shape, centrifugal force acts on the two-phase gas-liquid refrigerant. The two-phase gas-liquid refrigerant flowing out of the adjusting pipe 13 through the connecting member 13*b* flows into the second introduction pipe 11. In so doing, the two-phase gas-liquid refrigerant hits an inner wall surface of the second introduction pipe 11 and an inner wall surface of the lower end 11*b*, thereby cancelling out the centrifugal force, reducing the flow velocity, and further facilitating stirring of the two-phase gas-liquid refrigerant by impact of the hit. With the centrifugal force cancelled out, the two-phase gas-liquid refrigerant stirred sufficiently flows upward in the second introduction pipe 11, and is distributed to the individual branch pipes 10. In this way, by cancelling out the centrifugal force acting on the two-phase gas-liquid refrigerant, reducing the flow velocity of the refrigerant, stirring the refrigerant sufficiently as well, and then distributing the two-phase gas-liquid refrigerant to the individual branch pipes 10, it becomes possible to distribute homogeneous refrigerant to each indoor unit.

Advantageous Effects of Embodiment 2

Thus, according to Embodiment 2, the adjusting pipe 17 is installed by being inclined toward the branch pipes 10. Consequently, in addition to the effects of Embodiment 1, by cancelling out the centrifugal force acting on the two-phase gas-liquid refrigerant, reducing the flow velocity of the refrigerant, stirring the refrigerant sufficiently as well, and then distributing the two-phase gas-liquid refrigerant to the individual branch pipes 10, it becomes possible to distribute homogeneous refrigerant to each indoor unit.

Embodiment 3

A basic configuration of a refrigerant distributor according to Embodiment 3 is similar to that of the refrigerant distributor according to Embodiment 1, and thus Embodiment 3 will be described below by focusing on differences from Embodiment 1. A difference of Embodiment 3 from Embodiment 1 lies in that the adjusting pipe has a rectilinear shape.

Figure 15:
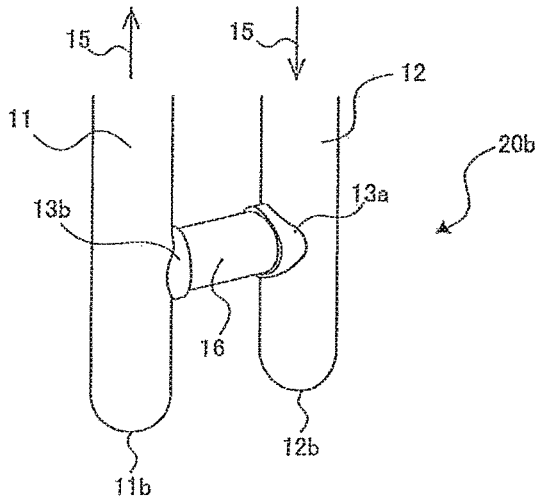
FIG. 15 is an enlarged schematic perspective view of a lower end of a refrigerant distributor according to Embodiment 3 of the present invention.

FIG. 15 is an enlarged schematic perspective view of a lower end of the refrigerant distributor according to Embodiment 3 of the present invention. As shown in FIG. 15, a refrigerant distributor 20*b* includes an adjusting pipe 16, a first introduction pipe 12, and a second introduction pipe 11. The adjusting pipe 16 has a rectilinear shape in top view. The adjusting pipe 16 is connected to the first introduction pipe 12 via a connecting member 13*a*, and to the second introduction pipe 11 via a connecting member 13*b*. When the first introduction pipe 12 and second introduction pipe 11 are placed vertically in a level flat site, the adjusting pipe 16 is connected to the first introduction pipe 12 and second introduction pipe 11 in a horizontal direction. Note that although in the example shown in Embodiment 3, the adjusting pipe 16 is connected in a horizontal direction, the present invention is not limited to this. For example, by installing the connecting member 13*a* of the first introduction pipe 12 at a higher level than the connecting member 13*b* of the second introduction pipe 11, the adjusting pipe 16 may be installed by being inclined. In that case, the refrigerant flowing out of the adjusting pipe 16 hits the lower end 11*b* of the second introduction pipe 11 more intensely, thereby stirring the two-phase gas-liquid refrigerant more vigorously and offering the effect of reducing the flow velocity of the refrigerant.

[Behavior of Refrigerant in Refrigerant Distributor]

Next, behavior of refrigerant in the refrigerant distributor 20*b* will be described.

As shown in FIG. 15, the two-phase gas-liquid refrigerant flowing into the first introduction pipe 12 from top to bottom hits an inner wall surface of the lower end 12*b* of the first introduction pipe 12, cancelling out downward momentum and stirring gas-phase refrigerant and liquid-phase refrigerant. Then, the two-phase gas-liquid refrigerant flows into the adjusting pipe 16 through the connecting member 13*a*. The two-phase gas-liquid refrigerant flowing out of the adjusting pipe 16 through the connecting member 13*b* flows into the second introduction pipe 11. In so doing, the two-phase gas-liquid refrigerant hits the inner wall surface and lower end 11*b* of the second introduction pipe 11, thereby reducing the flow velocity, and further facilitating stirring of the two-phase gas-liquid refrigerant by impact of the hit. The two-phase gas-liquid refrigerant stirred sufficiently flows upward in the second introduction pipe 11, and is distributed to the individual branch pipes 10. In this way, by reducing the flow velocity of the two-phase gas-liquid refrigerant, stirring the refrigerant sufficiently, and then distributing the two-phase gas-liquid refrigerant to the individual branch pipes 10, it becomes possible to distribute homogeneous refrigerant to each indoor unit.

Advantageous Effects of Embodiment 3

Thus, according to Embodiment 3, the adjusting pipe 16 has a rectilinear shape in top view. Consequently, in addition to the effects of Embodiment 1, Embodiment 3 provides the refrigerant distributor 20*b* capable of reducing the flow velocity of the refrigerant and facilitating stirring of the two-phase gas-liquid refrigerant.

Also, on the adjusting pipe 16, the connecting member 13*a* on the side of the first introduction pipe 12 is connected at a higher level than the connecting member 13*b* on the side of the second introduction pipe 11. Consequently, the refrigerant flowing out of the adjusting pipe 16 hits the lower end 11*b* of the second introduction pipe 11 more intensely, thereby stirring the two-phase gas-liquid refrigerant more vigorously and offering the effect of reducing the flow velocity of the refrigerant.

Embodiments 1 to 3 of the present invention have been described above, but the present invention is not limited to the embodiments described above. For example, parts or all of the embodiments may be combined.

The invention claimed is:

1. A refrigerant distributor comprising:

a first introduction pipe configured to be open at a first end and closed at a second end and to cause refrigerant to flow from the first end toward the second end;

a second introduction pipe configured to be closed in ends on both upstream and downstream sides and to cause the refrigerant to flow in a direction opposite to a refrigerant flow direction in the first introduction pipe;

a plurality of branch pipes connected to the second introduction pipe along the direction of the refrigerant through the second introduction pipe; and an adjusting pipe configured to connect the first introduction pipe and the second introduction pipe, the adjusting pipe connecting a part of the first introduction pipe, the part being on a side of the second end, connecting a side of the second end of the first introduction pipe to between an end of the second introduction pipe on the upstream side and an upstream-most branch pipe of the plurality of branch pipes, the upstream-most branch pipe being connected to a most upstream side of the second introduction pipe among the plurality of branch pipes, wherein the adjusting pipe has a U-shape in top view.

2. The refrigerant distributor of claim 1, wherein the first introduction pipe is configured to, when placed vertically, cause the refrigerant to flow from top to bottom; and the second introduction pipe is configured to, when placed vertically, cause the refrigerant to flow from bottom to top.

3. The refrigerant distributor of claim 1, wherein the adjusting pipe has a diameter smaller than inside diameters of the first introduction pipe and the second introduction pipe.

4. The refrigerant distributor of claim 1, wherein the adjusting pipe is installed perpendicularly to the first introduction pipe and the second introduction pipe.

5. The refrigerant distributor of claim 1, wherein the adjusting pipe is inclined toward the branch pipes.

6. An air-conditioning apparatus comprising:

a refrigeration cycle formed by a compressor, a condenser, a plurality of outdoor expansion valves, and a plurality of evaporators connected in series via refrigerant pipes; and the refrigerant distributor of claim 1 installed between the condenser and the plurality of outdoor expansion valves.

7. The air-conditioning apparatus of claim 6, wherein the compressor, the condenser, the plurality of outdoor expansion valves, and the refrigerant distributor are mounted on a single outdoor unit.

* * * * *